US005440381A

United States Patent [19]

Suzuki et al.

[11] Patent Number: 5,440,381

[45] Date of Patent: Aug. 8, 1995

[54] SHEET CONVEYANCE APPARATUS FOR AN IMAGE FORMING APPARATUS

[75] Inventors: Chikatsu Suzuki; Shigetaka Kurosu; Kazunobu Miura, all of Tokyo, Japan

[73] Assignee: Konica Corporation, Tokyo, Japan

[21] Appl. No.: 124,025

[22] Filed: Sep. 21, 1993

[30] Foreign Application Priority Data

Sep. 22, 1992 [JP] Japan ..... 4-278082

[51] Int. Cl.[6] ..... G03G 15/00

[52] U.S. Cl. ..... 355/309; 355/315

[58] Field of Search ..... 355/200, 309, 315, 308; 271/307, 308, 311

[56] References Cited

U.S. PATENT DOCUMENTS 4,165,168 8/1979 Baumann et al. ..... 355/200

4,387,981 6/1983 Cormier ..... 355/315

FOREIGN PATENT DOCUMENTS 125075 7/1983 Japan .

OTHER PUBLICATIONS

Japanese Published Utility Model Application No. 31435/1977.

*Primary Examiner*—Joan H. Pendegrass

*Attorney, Agent, or Firm*—Finnegan, Henderson, Farabow, Garrett & Dunner

[57] ABSTRACT

A sheet conveyance device for conveying a recording sheet in use with a coping machine. The sheet conveyance device includes a photoreceptor, having a moving surface, for holding a toner image; a photoreceptor driver for driving the moving surface of the photoreceptor at a first linear speed; an image forming device, including a latent image writer and a developer of the latent image with toner, for forming the toner image on the moving surface; a transferor for transferring the toner image from the moving surface onto the recording sheet at a transfer processing section; an intermediate conveyance device for conveying the recording sheet from the transfer processing section to a conveyance unit; and the conveyance unit, having a unit body, for conveying the recording sheet from the intermediate conveyance device to outside of the coping machine. The intermediate conveyance device further includes a conveying roller for conveying the recording sheet; and a conveying roller driver for driving the conveying roller at a second linear speed; in which the second linear speed of the conveying roller is higher than the first linear speed of the moving surface of the photoreceptor.

8 Claims, 6 Drawing Sheets

SHEET CONVEYANCE APPARATUS FOR AN IMAGE FORMING APPARATUS

BACKGROUND OF THE INVENTION

The present invention relates to a conveyance apparatus to convey a transfer sheet, onto which an image is transferred at a transfer processing section, in an electronic copier or the like.

In an image forming apparatus such as a copier and the like, the following operations are conducted: a document image is exposed on a photoreceptor; the image on the photoreceptor is developed and a toner image is formed thereon; the toner image on the photoreceptor is transferred onto a transfer sheet in the transfer processing section; and further, the toner image is fixed on the transfer sheet after heating and pressing operations are performed. As a conveyance apparatus used for the foregoing image forming apparatus, one example of the apparatus includes a conveyance unit provided to a rear part of the transfer processing section by which the toner image on the photoreceptor is transferred onto the transfer sheet. Conveyance rollers are provided between the conveyance unit and the transfer processing unit so that the transfer sheet is guided from the transfer processing section to the conveyance unit through the conveyance rollers. For example, the foregoing conveyance apparatus is described in Japanese Published Patent Application No. 125075/1983, and Japanese Published Utility Model Application No. 31435/1977.

As described above, when the conveyance roller is used in order to smoothly guide the transfer sheet to the conveyance unit, transfer slippage at the transfer processing section is prevented. However, since the position of the conveyance roller is fixed, its line speed is not regulated. Additionally, since conveyance apparatus has only a guiding function by which the transfer sheet is supported, conveyance properties are deteriorated, the transfer sheet can not be appropriately conveyed, and transfer slippage can not be sufficiently prevented with respect to both thick paper and regular paper.

In view of the foregoing problems, the object of the present invention is to provide a conveyance apparatus by which conveyance properties of the transfer sheet are improved, and transfer slippage is prevented.

SUMMARY OF THE INVENTION

In order to solve the foregoing problems, the conveyance apparatus of the present invention, by which a transfer sheet is guided from a transfer processing section to a conveyance unit through a conveyance means, comprises a conveyance unit provided to a rear part of the transfer processing section by which a toner image on a photoreceptor is transferred onto the transfer sheet. The conveyance means is provided between the conveyance unit and the transfer processing section and is characterized in that driving force is given to the conveyance means and a linear speed of the conveyance means is higher than that of the photoreceptor.

Further, the foregoing conveyance apparatus is characterized in that driving force is given to the conveyance means; and a contact portion of the conveyance means with the transfer sheet can be changed in the vertical direction, corresponding to the kind of transfer sheet, with respect to an extended line to the sheet delivery direction by which the contact portion of the photoreceptor with the transfer sheet is connected to the contact portion of the transfer processing section with the transfer sheet.

In the present invention, although the transfer sheet is guided to the conveyance unit through the conveyance means, since the line speed of the conveyance means is higher than that of the photoreceptor, the transfer sheet is pulled in the direction in which the transfer sheet is separated from the transfer processing section. Therefore, the separated transfer sheet can be sent to the conveyance unit at high speed by the conveyance means so that transfer slippage can be reduced.

Further, in the present invention, although the transfer sheet is guided from the transfer processing section to the conveyance unit, the contact portion of the conveyance means with the transfer sheet is withdrawn below the extended line when the transfer sheet is, for example, a regular paper, and it is positioned on the extended line or above the extended line when the transfer sheet is a thick paper. Therefore, the transfer sheet is always contacted with the conveyance means irrespective of the kind of transfer sheet. Due to the foregoing, the transfer sheet separated from the transfer processing section can be securely sent to the conveyance unit by the conveyance means, so that transfer slippage can be reduced.

In this embodiment, "a regular paper" is defined as the transfer sheet having the weight not more than 80 $g/m^2$, and "a thick paper" is defined as the transfer sheet having the weight more than 80 $g/m^2$.

DETAILED DESCRIPTION OF THE INVENTION

Figure 1:
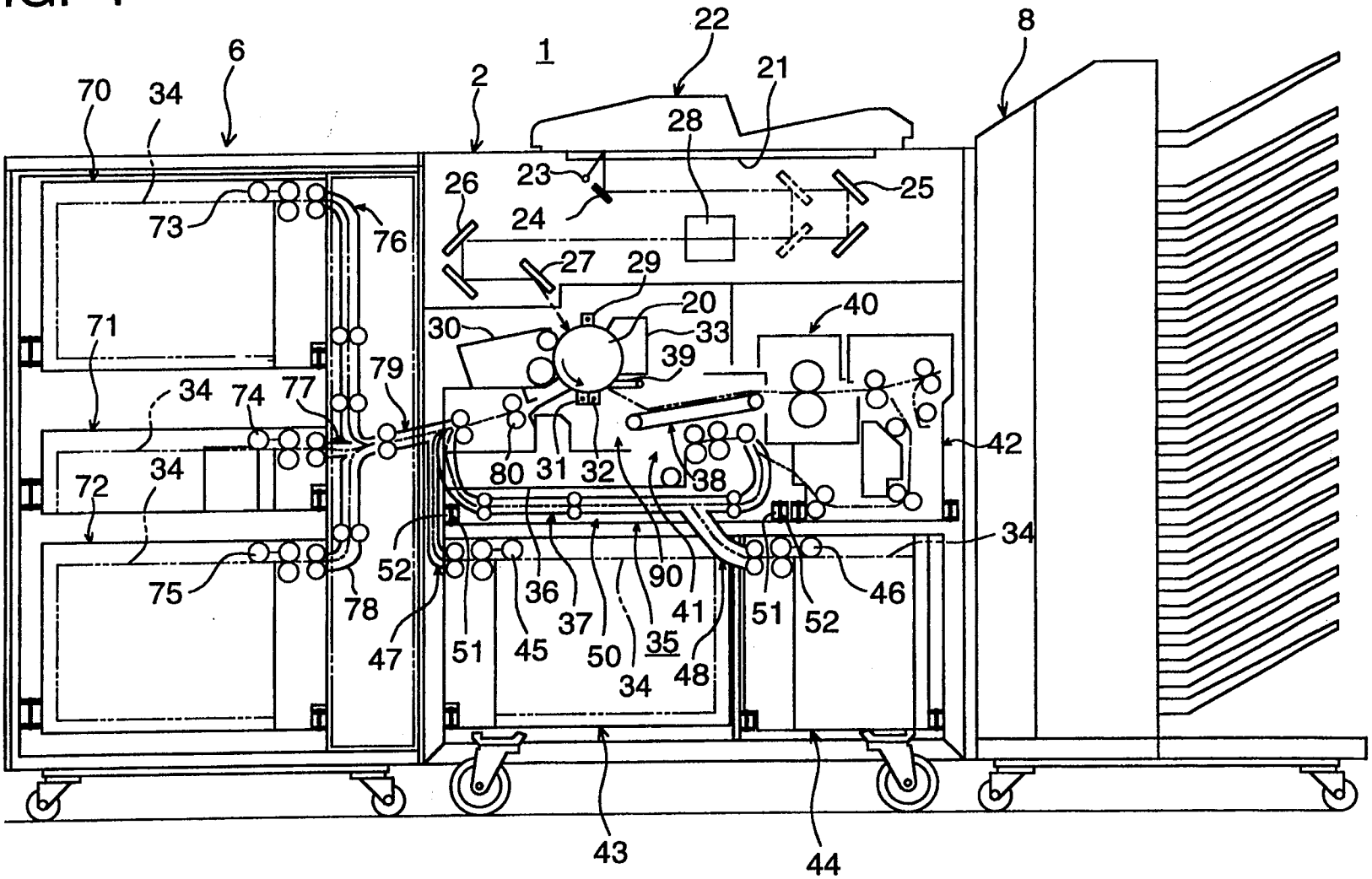
FIG. 1 is a view showing a general structure of an image forming apparatus with a conveyance apparatus.

Next, referring to the attached drawings, an example of a conveyance apparatus of the present invention will be described as follows. FIG. 1 is a view showing a general structure of an image forming apparatus with a conveyance apparatus. The image forming apparatus 1 comprises an apparatus main body section 2, a sheet feed unit section 6 which is connected with one side of the apparatus main body section 2, and a sorter unit section 8 which is connected with the other side of the apparatus main body section 2.

A photoreceptor 20 is rotatably provided in the arrowed direction in the apparatus main body section 2, and a platen glass 21 is provided in the upper portion of the apparatus main body 2. An automatic document reversal feeding apparatus 22 is provided in an upper portion of the platen glass 21, and the document is automatically reversed and both surfaces of the document can be copied as long as the two-sided document is set in the apparatus 22. An optical system composed of a light source 23, mirrors 24, 25, 26, 27, and a lens 28, is provided in a lower position of the platen glass 21, and an image of the document set on the platen glass 21 is exposed onto the photoreceptor 20 by the optical system. The light source 23 and mirrors 24, 25 and 26 of the optical system are reciprocated by being linked with each other at the time of exposure, and the lens 28 and the mirror 26 are moved by being linked with each other at the time of variable magnification.

A charging electrode 29, a developing unit 30, a transfer electrode 31, a separation electrode 32, and a cleaning unit 33 are provided around the photoreceptor 20. The image exposed onto the photoreceptor 20 by the optical system is developed and a toner image is transferred onto a transfer sheet 34 for recording. A transfer processing section 90 composed of the transfer electrode 31 and the separation electrode 32 is provided in an automatic two-sided transfer apparatus 35, and further, an accommodation tray 36, a conveyance path 37, and a conveyance unit 38 are provided in the automatic two-sided transfer apparatus 35. The transfer electrode 31, the separation electrode 32, the accommodation tray 36, the conveyance path 37 and the conveyance unit 38 are integrally provided in a frame 50 as one unit. A rail 51 is provided in the frame 50. The rail 51 is slidably engaged with a rail 52 provided in the apparatus main body 2, and the automatic two-sided transfer apparatus 35 can be drawn to the front side of the apparatus main body 2.

In the automatic two-sided transfer apparatus 35, when an image has been transferred onto a single side of the transfer sheet, the transfer sheet 34, onto one side of which the image has been transferred, is sent to the conveyance unit 38 through a separation claw 39, and sent from the conveyance unit 38 to a fixing unit 40. An automatic reversal sheet delivery unit 42 is provided in a rear part of the fixing unit 40, and the transfer sheet 34 passes through the automatic reversal sheet delivery unit 42 without any operation and is sent to a sorter unit section 8. In the sorter unit section 8, the transfer sheets are automatically collated and sorted.

When images are transferred onto both surfaces of the transfer sheet 34, the transfer sheet 34 is reversed in the automatic reversal sheet delivery unit 42, and the transfer sheet 34, onto one side of which the image has been transferred, is accommodated once in the accommodation tray 36 of the automatic two-sided transfer apparatus 35. The transfer sheet 34 is sent out from a sheet feeding mechanism 41, conveyed on the conveyance path 37, and sent to the transfer electrode 31 and the separation electrode 32 again. Then, the transfer operation is carried out on the reverse side of the transfer sheet 34, and the separation operation is carried out. Similarly, the transfer sheet 34 is sent to the conveyance unit 38 through a separation claw 39, passes through the fixing unit 40 and the automatic reversal sheet delivery unit 42 from the conveyance unit 38 without any operation, and is sent to the sorter unit section 8.

Sheet feeding sections 43 and 44 are laterally provided below the apparatus main body section 2, and the transfer sheets 34 are accommodated in these sheet feeding sections 43 and 44. Feeding rollers 45 and 46 are respectively provided in the sheet feeding sections 43 and 44, and intermittently send the transfer sheet 34 by the rotation of a driving motor, which is not shown in the drawings, with which both rollers are connected. The transfer sheet 34 sent from one of sheet feeding sections 43 and 44, is sent from one of conveyance paths 47 and 48 to the conveyance path 37 of the automatic two-sided transfer apparatus 35.

Three sheet feeding sections 70, 71 and 72 are provided in the vertical direction in the sheet feeding section 6 connected with the apparatus main body 2, and transfer sheets 34 are accommodated in these sheet feeding sections 70, 71 and 72 respectively. Feeding rollers 73, 74 and 75 are respectively provided in sheet feeding sections 70, 71 and 72, and intermittently send out the transfer sheet 34 respectively by the rotation of the driving motor, which is not shown in the drawings, with which the feeding rollers are connected. Each transfer sheet 34 sent out respectively from sheet feeding sections 70, 71 and 72, is sent to the conveyance path 37 of the automatic two-sided transfer apparatus 35 through a conveyance path 79 from one of conveyance paths 76, 77 and 78. A registration roller 80 is provided just before the transfer processing section in the conveyance path 37. The transfer sheet 34 is pushed to the registration roller 80 and is stopped, and thereby skew of the leading edge of the transfer sheet 34 is corrected.

Figure 2:
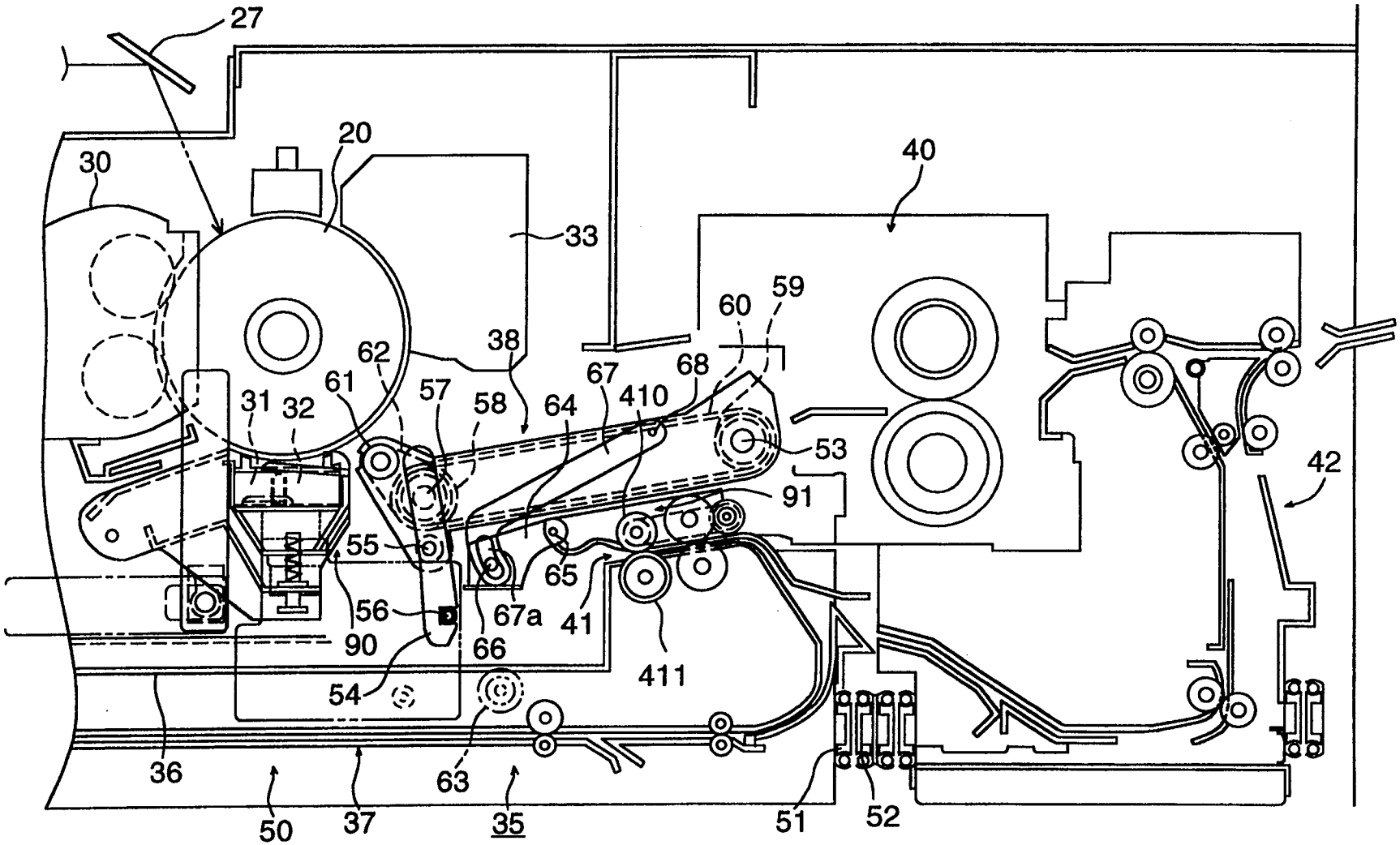
FIG. 2 is a side view of an automatic two-sided transfer device.
Figure 3:
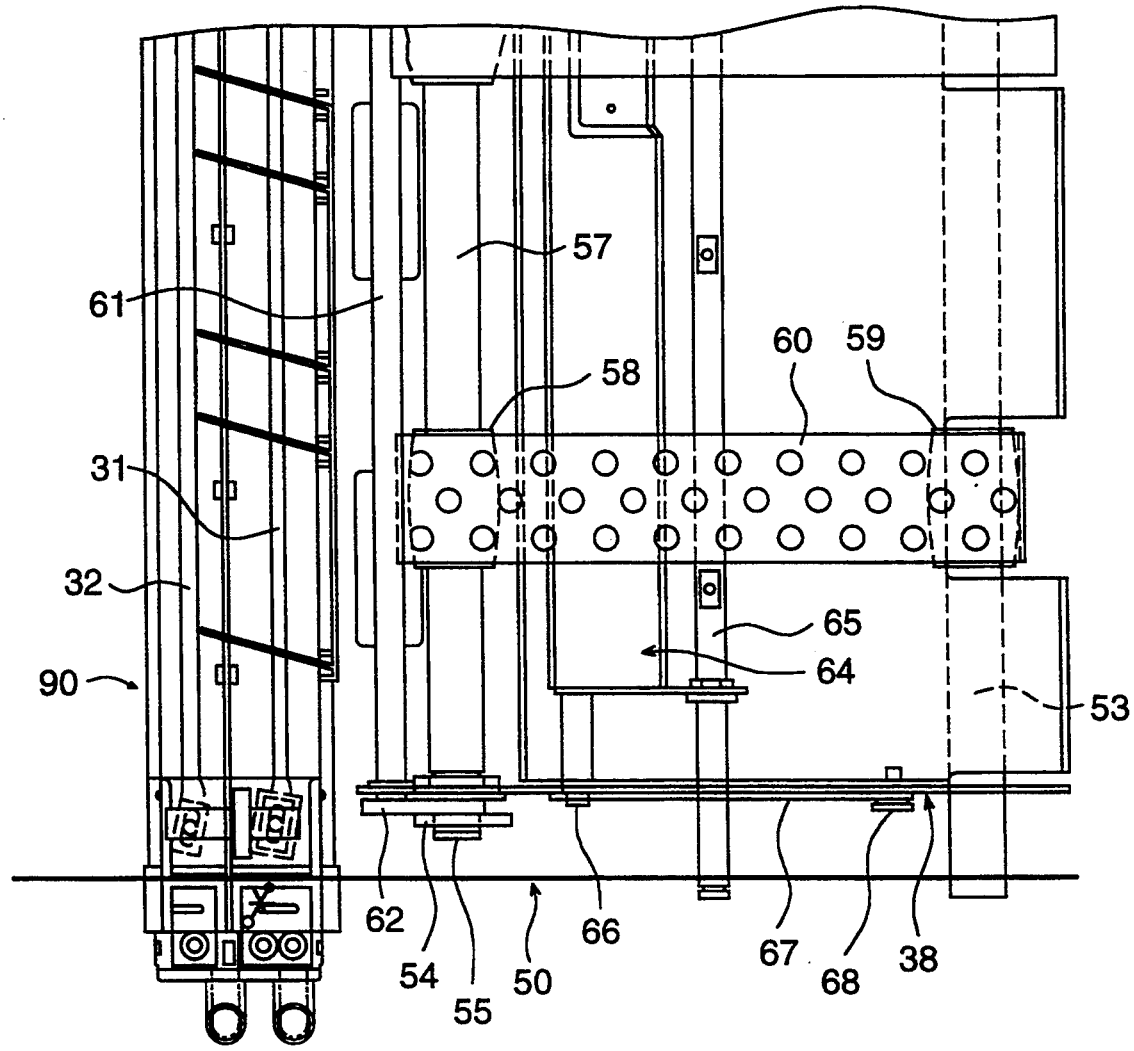
FIG. 3 is a plan view of the automatic two-sided transfer device.
Figure 4:
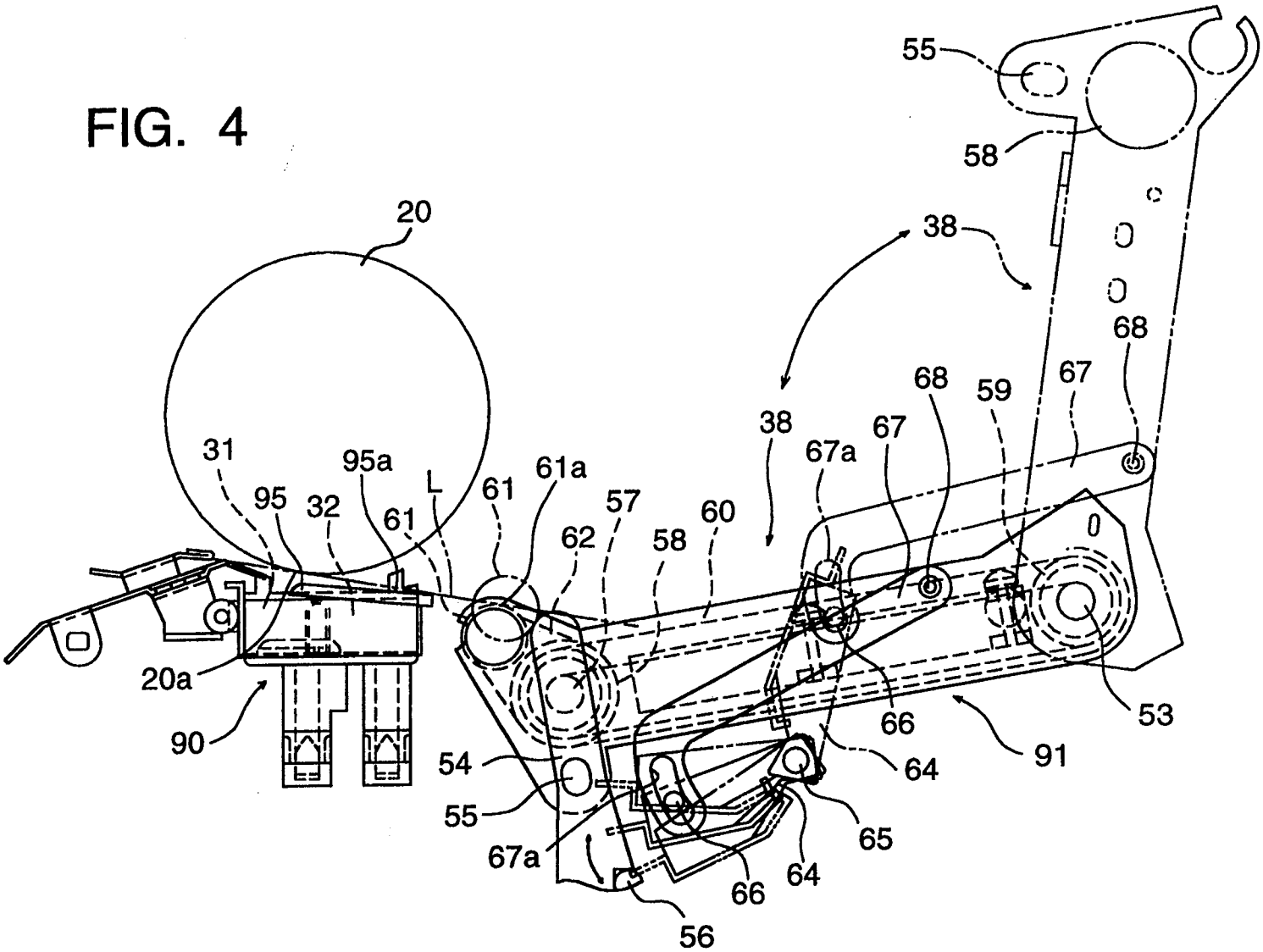
FIG. 4 is a view showing the condition that a conveyance unit and a pressure plate are opened and closed.

Next, the automatic two-sided transfer apparatus provided with the foregoing conveyance apparatus will be described in detail as follows. FIG. 2 is a side view of the automatic two-sided transfer apparatus, FIG. 3 is a plan view of the automatic two-sided transfer apparatus, and FIG. 4 is a view showing the condition that the conveyance unit and pressure plate are opened and closed.

The conveyance unit 38 of the automatic two-sided transfer apparatus 35 is arranged in a rear part of the transfer processing section 90 by which the toner image on the photoreceptor 20 is transferred onto the transfer sheet 34. The conveyance unit 38 can be opened and closed around a supporting shaft 53 which is positioned on the front side in the conveyance direction. A lock lever 54 is provided on the transfer processing section side of the conveyance unit 38 so that the lock lever 54 can be rotated around a supporting shaft 55. When the lock lever 54 is engaged with a lock pin 56 fixed on the frame 50 side, the conveyance unit 38 is set, and when the lock lever 54 is disengaged, the conveyance unit 38 can be opened. A driving shaft 57 is provided in the conveyance unit 38, and a roller 58 is rotatably provided integrally with the driving shaft 57. A belt 60 is stretched between the roller 58 and a roller 59 which is rotatably provided on the supporting shaft 55, and the belt 60 is rotated by the driving force given to the driving shaft 57.

A conveyance roller 61, which is one example of a conveyance means, is rotatably supported on the transfer processing section side of the conveyance unit 38, and the conveyance roller 61 is rotated by being linked with the driving shaft 57 through a belt 62. The driving force is given to the conveyance roller 61, and the line speed of the conveyance roller 61 is set to be higher than that of the photoreceptor 20 within the range of 5%, preferably within the range of 3%.

As described above, the transfer sheet 34 is guided from the transfer processing section 90 to the conveyance unit 38 through the conveyance roller 61, and the linear speed of the conveyance roller 61 is higher than that of the photoreceptor 20. Therefore, the conveyance roller 61 pulls the transfer sheet 34 from the transfer processing section 90 to the direction of sheet separation. Thereby, the condition that the transfer sheet 34 is loosened can be prevented, and the separated transfer sheet 34 can be conveyed quickly to the conveyance unit 38 by the conveyance roller 61, so that the transfer slippage can be improved.

As shown in FIG. 4, a contact portion 61*a* of the conveyance roller 61 with the transfer sheet 34 can be positioned on the extended line L in the sheet delivery direction connecting the contact portion 20*a* of the photoreceptor 20 with the transfer sheet 34, with a contact portion 95*a* of a guide plate 95 of the transfer processing section 90 with the transfer sheet 34. Alternatively, the contact portion 61*a* can be positioned lower than the extended line L within the range of 1 mm. As described above, with respect to the transfer sheet 34 of a regular paper, it is preferable that the conveyance roller 61 is positioned on the extended line, or lower than the extended line L within the range of 1 mm, to prevent collision of the leading edge of the sheet with the photoreceptor, and to increase the conveyance effect of the trailing edge of the sheet.

The conveyance roller 61 is lifted by a solenoid, which is not shown in the drawing, by a thick paper transfer sheet selection signal as shown by the two-dotted-chain line in FIG. 4, and the contact portion 61*a* can be positioned above the extended line L within 10 mm. In this case, although the transfer sheet 34 is guided from the transfer processing section 90 to the conveyance unit 38 through the conveyance roller 61, the transfer sheet 34 of a thick paper is not separated from the contact portion 61*a* of the conveyance roller 61 and is always contacted with the contact portion 61*a*. Therefore, the transfer sheet separated from the transfer processing section 90 can be securely sent to the conveyance unit 38 by the conveyance roller 61, so that transfer slippage can be improved.

The accommodation tray 36 is located below the conveyance unit 38, and the reversed transfer sheet 34 is temporarily accommodated in the accommodation tray 36. A sending roller 63 is movably provided in the vertical direction below the accommodation tray 36. When the transfer sheet 34 is sent from the tray, the sending roller 63 is lifted, and thereby, the transfer sheet 34 is pushed to the pressure plate 64 with pressure and the pressing force is applied to the transfer sheet 34. Thereby, the transfer sheet 34 which is accommodated in the lowest portion of the tray is guided to the sheet feeding mechanism 41 by the rotation of the sending roller 63. The sheet feeding mechanism 41 is composed of a feeding roller 410 and a separation roller 411. The transfer sheets 34 guided between the feeding roller 410 and the separation roller 411 are sent one by one from the accommodation tray 36 to the conveyance path 37, and conveyed along the conveyance path 37.

The pressure plate 64, by which the pressing force is given to the transfer sheet 34, is rotatably supported by the conveyance unit 38 through a supporting shaft 65, and connecting pins 66 are provided on both sides of the pressure plate 64. The connecting pin 66 is movably inserted into a long groove 67*a* of a link 67, and the link 67 is rotatably supported by the conveyance unit 38 by a support pin 68.

Since the pressure plate 64 is supported by the long groove 67*a* of the link 67 through the connection pin 66, the pressure plate 64 can give pressing force to the transfer sheet 34 by its own weight. The pressure plate 64 is connected with the conveyance unit 38 through a link mechanism 91 composed of the connection pin 66 and the link 67, and can be opened and closed by being linked with the conveyance unit 38.

Accordingly, in the case where the transfer sheet 34 is sent from the accommodation tray 36 by the drive of the sending roller 63, when paper jamming occurs, the copying operation is stopped, and the automatic two-sided transfer apparatus 35 is pulled out to the operator's side. Under the condition that the apparatus 35 is pulled out, the lock lever 54 is disengaged from the lock pin 56 so that the conveyance unit 38 can be opened and closed. Then, when the conveyance unit 38 is opened in the arrowed direction as shown in FIG. 4, the following operations can be conducted. The link 67 is pulled; the pressure plate 64, which gives the pressing force to the transfer sheet 34, is opened around the support shaft 65 through the connection pin 66; and the upper space of a portion from which the transfer sheet 34 in the accommodation tray 36 is sent out, so as to be widely opened. Therefore, the space for paper jamming processing can be greatly secured by a simple operation, and thereby, the conveyance unit 38 and pressure plate 64 do not disturb the paper jamming processing operation. Further, when the paper jamming processing operation has been completed, the conveyance unit 38 is closed, and the pressure plate 64 is closed by being linked with the conveyance unit 38. Therefore, the paper jamming processing operation can be effectively carried out in a short period of time, so that the operability can be improved.

Figure 5:
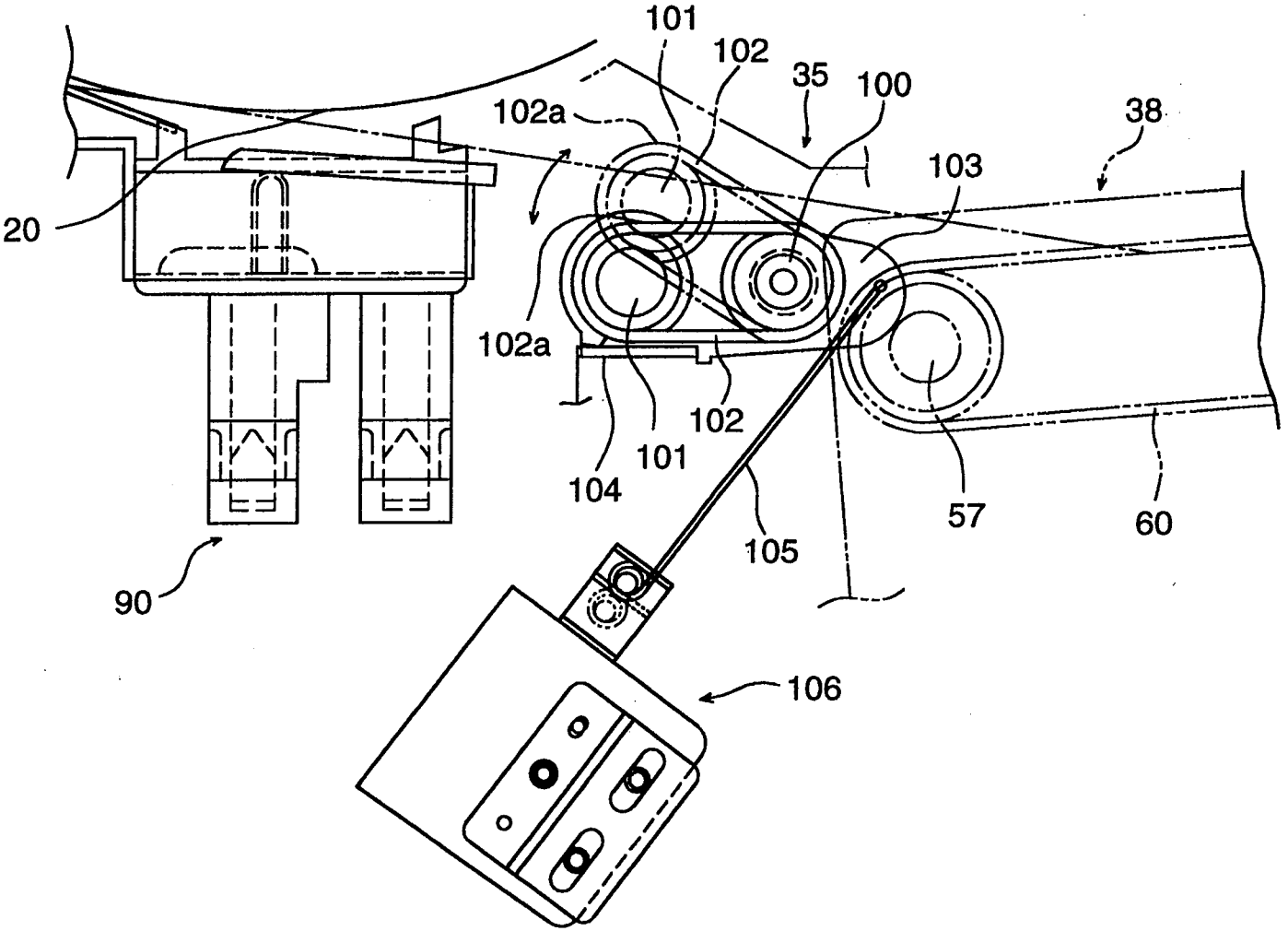
FIG. 5 is a plan view of the automatic two-sided transfer device.
Figure 6:
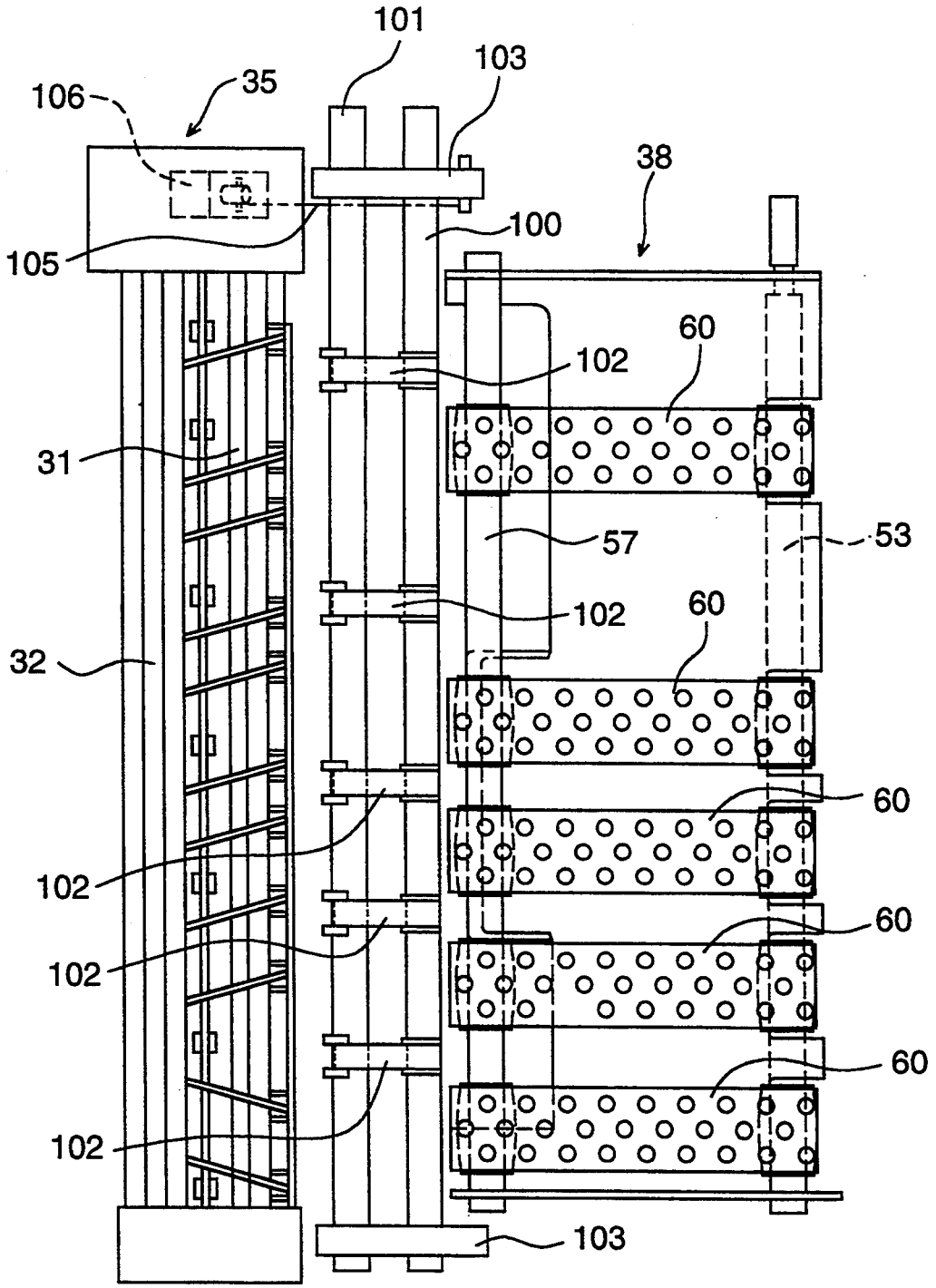
FIG. 6 is a partially enlarged side view of the automatic two-sided transfer device.

FIG. 5 and FIG. 6 show other examples of the invention. FIG. 5 is a plan view of the automatic two-sided transfer apparatus, and FIG. 6 is a partially enlarged side view of the automatic two-sided transfer apparatus.

In this example, a drive shaft 100 is provided in the automatic two-sided transfer apparatus 35. An auxiliary belt 102, which is another example of a conveyance means, is stretched between the drive shaft 100 and a driven shaft 101, and the auxiliary belts 102 are provided in, for example, five portions. The driven shaft 101 is rotatably supported by a pair of support plates 103, which are left and right support plates. The pair of support plates 103 are rotatably supported around the axis of the drive shaft 100. The lower position of the support plates 103 is regulated by a stopper 104, and an end portion of one support plate 103 is connected with a solenoid 106 through a wire.

Accordingly, with respect to the transfer sheet 34 of a regular paper, it is preferable that the auxiliary belt 102 is positioned on the extended line L, or lower than the extended line L within the range of 1 mm, to prevent collision of the leading edge of the sheet with the photoreceptor, and to increase the conveyance effect of the trailing edge of the sheet.

The solenoid 106 is actuated by a thick paper transfer sheet selection signal as shown by the two-dotted-chain line in FIG. 5, and the support plate 103 is pulled through the wire 105. Thereby, the support plate 103 is rotated around the axis of the drive shaft 100, and the auxiliary belt 102 can be positioned above the extended line L within 10 mm. In this case, although the transfer sheet 34 is guided from the transfer processing section 90 to the conveyance unit 38 through the auxiliary belt 102, the transfer sheet 34 of a thick paper is not separated from a contact portion 102*a* of the auxiliary belt 102 with the transfer sheet 34 and always contacted with the contact portion 102*a*. Therefore, the transfer sheet separated from the transfer processing section 90 can be securely sent to the conveyance unit 38 by the auxiliary belt 102, so that transfer slippage can be improved. Accordingly, when the conveyance roller 61 in the foregoing example is replaced with the auxiliary belt 102, a more preferable conveyance operation can be carried out.

As described above, in the present invention, although a transfer paper is guided from a transfer processing section to a conveyance unit through a conveyance means, driving force is given to the conveyance means, and line speed of the conveyance means is higher than that of a photoreceptor. Therefore, the transfer sheet is pulled from the transfer processing section to the direction of sheet separation when the conveyance means is driven, and the separated transfer sheet can be sent to the conveyance unit by the conveyance means, so that transfer slippage can be improved. Further, with respect to the transfer sheet of a regular paper, it is preferable that the conveyance means is located in a lower position, because collision of the leading edge of the sheet with the photoreceptor can be prevented, and the conveyance effect of the trailing edge of the sheet can be increased.

Further, although the transfer sheet is guided from the transfer processing section to the conveyance unit through the conveyance means, a contact portion of the conveyance means with the transfer sheet, for example, when a regular paper is used, is withdrawn to a lower portion than an extended line, and when a thick paper is used, is positioned on the extended line or above the extended line. Accordingly, the transfer sheet is always contacted with the conveyance means irrespective of the kind of transfer sheet. Therefore, the transfer sheet separated from the transfer processing section can be securely sent to the conveyance unit by the conveyance means, so that transfer slippage can be improved.

What is claimed is:

1. A sheet conveyance apparatus for conveying a recording sheet in a conveyance path of an image forming apparatus, the conveyance apparatus comprising:

photoreceptor means having a moving surface for holding a toner image;

photoreceptor driving means for driving said moving surface of said photoreceptor means at a first linear speed;

image forming means for forming said toner image on said moving surface;

registration means, located prior to said image forming means in the conveyance path of the recording sheet, for correcting skew of the leading edge of the recording sheet at a registration section;

transfer means for transferring said toner image from said moving surface onto the recording sheet at a transfer processing section;

intermediate conveyance means for conveying said recording sheet from said transfer processing section, said intermediate conveyance means including a conveying member for conveying said recording sheet, and a conveying member driving means for driving said conveying member at a second linear speed, wherein said second linear speed of said conveying member is higher than said first linear speed;

fixing means for fixing said toner image transferred onto the recording sheet at a fixing section; and conveyance unit means, having a unit body, for conveying said recording sheet from said intermediate conveyance means to said fixing section;

wherein the conveyance path of the recording sheet between said registration section and said fixing section is substantially linear.

2. The apparatus of claim 1, wherein said second linear speed is greater than said first linear speed by not more than 5% of said first linear speed.

3. The apparatus of claim 2, wherein said second linear speed is greater than said first linear speed by not more 3% of said first linear speed.

4. The apparatus of claim 1, wherein said intermediate conveyance means is configured to convey a regular sheet having a weight not greater than 80 $g/m^2$ and a thick sheet having a weight greater than 80 $g/m^2$.

5. A sheet conveyance apparatus for conveying a recording sheet in a conveyance path of an image forming apparatus, the conveyance apparatus comprising:

photoreceptor means having a surface for holding a toner image, wherein said recording sheet comes in contact with said surface at a first contact portion;

image forming means for forming said toner image on said surface;

transfer means for transferring said toner image from said surface onto the recording sheet at a transfer processing section, wherein said recording sheet comes in contact with said transfer means at a second contact portion;

intermediate conveyance means for conveying said recording sheet from said transfer processing section, said intermediate conveyance means including a conveying member for conveying said recording sheet, wherein said recording sheet comes in contact with said conveying member at a third contact portion, said conveying member being supported movably in the vertical direction with respect to an extended line from a sheet delivery path which extends through said first contact portion and said second contact portion, conveying member driving means for driving said conveying member, and positioning means for positioning said conveying member between a first position where said third contact portion is below said extended line and a second position where said third contact portion is above said extended line according to characteristics of said recording sheet;

fixing means for fixing said toner image transferred onto the recording sheet at a fixing section; and conveyance unit means, having a unit body, for conveying said recording sheet from said intermediate conveyance means to said fixing section.

6. The apparatus of claim 5, wherein said positioning means positions said conveying member at said first position when said recording sheet has a normal thickness, and said positioning means positions said conveying member at said second position when said recording sheet has an extra thickness.

7. The apparatus of claim 6, wherein said first position is below said extended line not more than 1 mm, and said second position is above said extended line not more than 10 mm.

8. The apparatus of claim 5, further comprising;

photoreceptor driving means for driving said surface of said photoreceptor so that said surface is moved at a first linear speed;

wherein said conveying member driving means drives said conveying member to convey said recording sheet at a second linear speed; and further wherein said second linear speed of said conveying member is higher than said first linear speed.

* * * * *

UNITED STATES PATENT AND TRADEMARK OFFICE

CERTIFICATE OF CORRECTION

PATENT NO. : 5,440,381

DATED : August 08, 1995

INVENTOR(S) : Chikatsu SUZUKI et al.

It is certified that error appears in the above-indentified patent and that said Letters Patent is hereby corrected as shown below:

Claim 3, column 8, line 6, after "more" insert --than--.

Claim 8, column 8, line 59, "comprising;" should read --comprising:--.

Signed and Sealed this

Eighteenth Day of June, 1996

Bruce Lehman

*Attest:*

BRUCE LEHMAN

*Attesting Officer*

*Commissioner of Patents and Trademarks*